US005577604A

United States Patent [19]

Dahmen et al.

[11] Patent Number: 5,577,604

[45] Date of Patent: Nov. 26, 1996

[54] ELECTRICAL SNAP-ACTION SWITCH

[75] Inventors: Hans P. Dahmen, Wipperfurth; Ewald Stanitzok, Ennepetal, both of Germany

[73] Assignee: Delphi Automotive Systems Deutschland GmbH, Germany

[21] Appl. No.: 373,301

[22] PCT Filed: May 3, 1994

[86] PCT No.: PCT/DE94/00491

§ 371 Date: Mar. 13, 1995

§ 102(e) Date: Mar. 13, 1995

[87] PCT Pub. No.: WO94/27310

PCT Pub. Date: Nov. 24, 1994

[30] Foreign Application Priority Data

May 13, 1993 [DE] Germany ..... 43 16 068.9

[51] Int. Cl.[6] ..... H01H 5/14

[52] U.S. Cl. ..... 200/408; 200/406; 200/447

[58] Field of Search ..... 200/408, 406, 200/407, 443, 444, 448, 449, 461, 460, 275, 276

[56] References Cited

U.S. PATENT DOCUMENTS 5,016,140 5/1991 Prestel et al. ..... 200/460

FOREIGN PATENT DOCUMENTS

| | | |
|---|---|---|
| 0074004 | 8/1982 | European Pat. Off. . |
| 1201450 | 9/1965 | Germany . |
| 1640264 | 7/1970 | Germany . |
| 2350041 | 4/1975 | Germany . |
| 3236255 | 4/1984 | Germany . |
| 3438304 | 10/1986 | Germany . |
| 3801991 | 12/1990 | Germany . |
| 4003241 | 10/1992 | Germany . |
| 2196793 | 10/1986 | United Kingdom . |

*Primary Examiner*—David J. Walczak

*Attorney, Agent, or Firm*—Reising, Ethington, Barnard & Perry

[57] ABSTRACT

To create a snap-action switch (1) that provides separate solutions for the mechanical function of "switching" and the electrical function of "contact bridging", the snap-action element (4) is designed as one piece made of round wire and a contact element (5) is held within the snap-action element (4).

13 Claims, 3 Drawing Sheets

ELECTRICAL SNAP-ACTION SWITCH

The present invention is based on an electrical snap-action switch according to the preamble of the main claim.

Snap-action spring switching mechanisms are known in a very wide range of embodiments. The common aim is to make the actual switching speed, the switching force and the switching movement independent of the operation of the switch.

German patent document DE 3807411 A1 describes a snap-action switching element in which a contact link is operated via a slide which is guided in a straight line in the housing. The slide is in turn activated via a snap-action spring mechanism, by means of a spring-loaded plunger, toggle levers engaging in the slide once more on both sides. The complexity for functional isolation is considerable and leads to a complicated construction.

In addition to a large number of embodiments of snap-action springs, a structural form has been increasingly implemented such as that described in German patent document DE 3236255 A1. A snap-action spring having a spring tongue supported in a supporting bearing is in this case operated by plungers which in each case act on the two outer limbs of the snap-action spring. In this case, the current flows from the bearing at the clamped-in end via the outer limbs of the spring, and from the spring tongue bearing, via the spring tongue, to the contact points. German patent document DE 3438304 A1 shows a double snap-action spring of the above-mentioned type, the spring being borne in the center between the switching function regions. Flat switching plungers operate the individual snap-action springs, on the outer limbs of the spring in each case.

German patent document DE 38 01 991 C2 shows a toggle switch having two integrated snap-action switching elements, which are operated as a function of the position of the toggle lever. Corresponding plungers in each case act on the two outer limbs of the snap-action switching elements, whose spring tongues are clamped into supporting bearings in a prestressed manner. The current flows from the bearing at the clamped-in end, via the outer limbs, and from the spring tongue bearing, via the spring tongue, to the contact head. In order to ensure that the contact is made sufficiently well, only one point of the crowned contact head need come into contact with the mating contact.

German patent document DE 4003241 C2 shows a pressure switch (push button switch) with an integrated snap-action spring.

Furthermore, a pressure switch (push button switch) is known European patent document from EP 0 074 004 A2 in whose housing two fixed-position contact points are arranged, which are connected by a contact link. An operating element acts on the contact link, via a spring clip. During the forward travel, a snap-action effect is triggered by means of the spring clip, which is manufactured from round wire, in order to achieve a defined switching behavior and satisfactory contact making. The return travel is effected by means of an additional compression spring, without which the return travel could not take place. In the case of this type of return travel, the switch shows a switching behavior which is dependent on the operation. The contact link and the spring clip are not directly operatively connected, so that the switching behavior is influenced by a plurality of tolerances and is defined only in this framework.

In the case of all the types of switches equipped with the above-mentioned snap-action springs, a metal sheet made of spring bronze or copper/beryllium alloy is used as the base material for the spring. The spring material is on the one hand subject to the requirement for good conductivity while, on the other hand, good mechanical properties are expected in terms of springing. At the same time, very stringent requirements are placed on thickness tolerances and the surface quality of the initial material as well as the completed stamped part being free of burrs. These inherently contradictory material requirements relating to the mechanical switching behavior (spring effect) and good electrical conductivity necessarily lead to compromises in the structural design of the above-mentioned snap-action springs. As a result of this necessity, consideration has been given to isolating the switching function and conductor function. This has resulted in the possibility of optimizing both functional areas in accordance with the actual requirements.

The object of the invention is to create a switch having a snap-action spring effect, which includes separate solutions for the mechanical function of "switching" and the electrical function of "bridging the contacts" the intention being to achieve an extremely favorable overall result, by means of the design and selection of the materials, with respect to functionality, a small number of parts, and high level of assembly convenience.

The object is achieved according to the invention in that the snap-action unitary switching element is produced integrally from a round wire, and in that the contact element is held in a universally jointed manner within the snap-action switching element.

A round wire spring, which is bent from spring steel, is used instead of the leaf spring which is known from the prior art. During switching, the current is not carried via specific regions of the spring, but by bridging two contact points by means of a contact link which is mounted in the round spring wire. The contact link is held in a slightly universally jointed manner in the wire spring, which guarantees that contact is made reliably. Oval, elongated contact links can also be used instead of a round contact link, if a greater contact gap between the contact points makes this structurally necessary.

The retaining cap, which is made of conductor material and is required in the case of a leaf spring, is obviated, the wire spring is borne by a cap which is a component of an insulating material housing which is present anyway and is at the same time fitted with the points, for example in the form of conductor tracks, with which contact is to be made for the purpose of switching. The conductor tracks may be made from round or flat wires or from printed conductor tracks having contact rivets.

The snap-action switching element is operated via plungers which act on the outer limbs of the spring. It is thus possible to implement all the normal switching principles such as pressure, rocker, slide-action, tension, rotary and toggle operation, with the assistance of normal, known mechanical aids such as levers, bell cranks, an inclined plane, a cam disk, an eccentric, a peg wheel and the like.

The three-dimensional shape and the prestressed condition of the snap-action switching element result in the spring parts, which hold the contact element, spreading when pressure is exerted on the outer limbs. In order to ensure that the position of the contact element is held correctly even during the operation of the snap-action switching element, there are various solution options depending on the structural shape of the spring with respect thereto, which will be described. On the one hand, additional holding means can be arranged, while on the other hand the actual geometry of the snap-action switching element can be varied.

In the case of a fixed geometry and fixed external dimensions, the spring force can be varied relatively simply by changes in the diameter of the spring wire. The use of spring steel instead of copper/beryllium permits a considerably smaller construction, of course, for the same stress. The operating forces and movements can be adjusted by displacing the plunger on the spring limbs.

Further advantageous refinements of the subject matter of the invention are specified in the subclaims.

Various exemplary embodiments of the invention are explained in more detail with reference to FIGS. 1 to 4.

Figure 1:
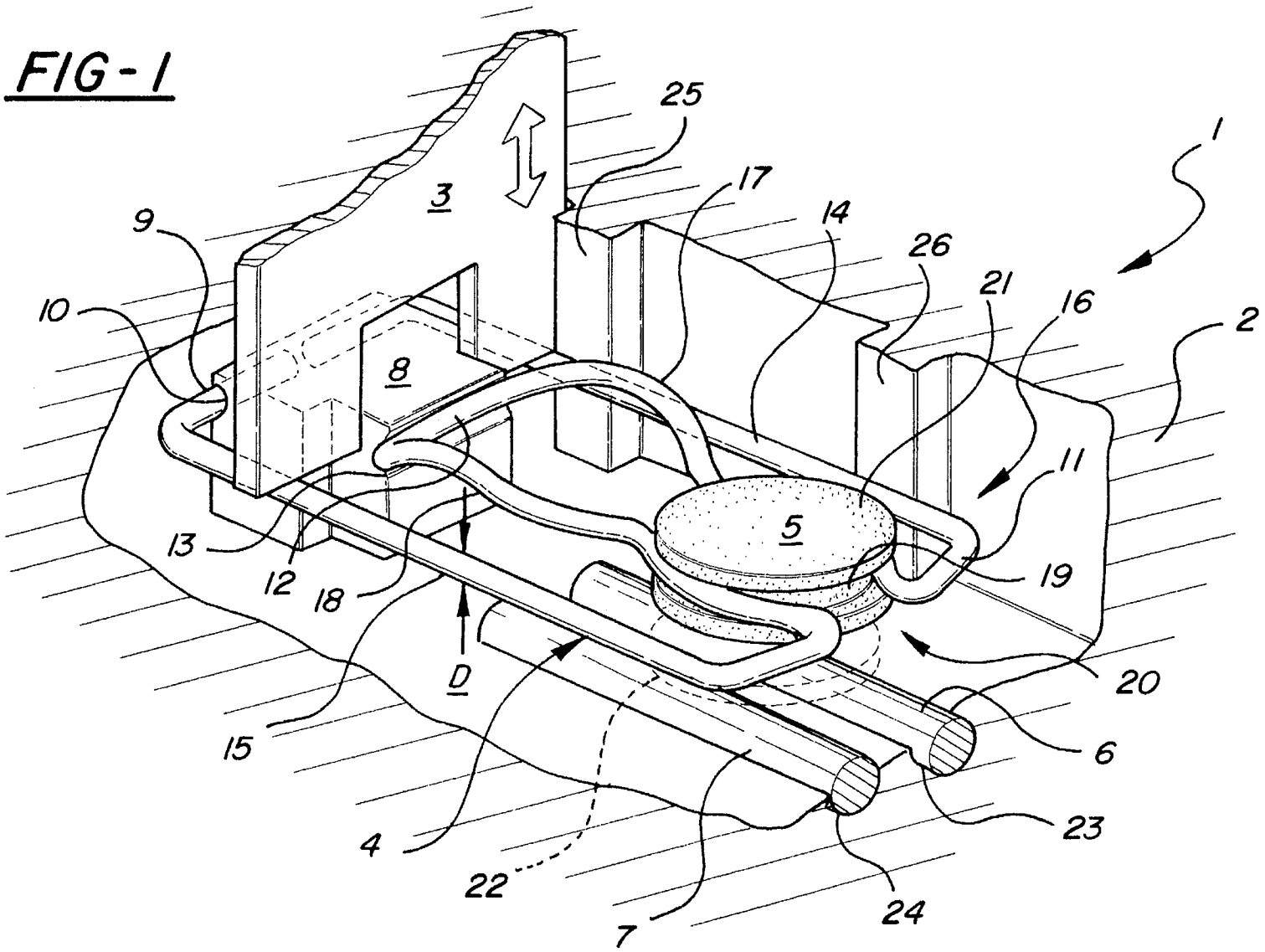
FIG. 1 shows a partial perspective view of a snap-action switch.

An electrical snap-action switch 1 of the type generally described above, for example a break contact/open contact, is mainly composed of a housing 2, an operating element 3 which is guided displaceably in the housing 2, a snap-action switching element 4 which is associated with the operating element 3, a contact element 5, and at least two current-carrying contact points 6 and 7. The arrangement which is implemented in this snap-action switch 1 furthermore includes a support 8, which is a component of the housing 2. The snap-action switching element 4 is a bent round wire spring, which is held by one side 9 in a bearing point 10 of the support 8. A U-shaped spring 12, which is domed or arched upwards, projects into the snap-action switching element 4 from an opposite side 11 and is supported in a further bearing point 13 of the support 8, in a slightly prestressed manner. The spring 12 is preferably designed to be as wide as the lateral limbs 14 and 15 of the frame-like snap-action switching element 4 allow.

In the rear region 16 of the spring 12, its inner limbs 17 and 18 are formed outwards in a slightly semi-circular shape, in order to hold the contact element 5 by means of its circumferential annular groove 19. The annular groove 19 is designed to be somewhat wider than the wire diameter D, as a result of which the contact element 5 is borne in a universally jointed manner. The contact element 5 is installed through an opening 20 in the snap-action switching element 4 by said opening being opened in a slightly sprung manner while the contact element 5 is being pressed in, until the contact element 5 has reached its position. The contact element 5 is primarily of round design for production-engineering reasons, but can also be of elongated and/or oval design in the region of its crowned contact surfaces 21 and 22 if, for example, relatively large contact gaps or distances between the conductor tracks make this necessary. In this case, a rotation protection device, which is not illustrated here in more detail, is necessary on the housing side. The contact surfaces 21 and 22 can be designed to be straight or flat on one or both sides, or crowned as illustrated.

The snap-action switching element 4 is secured in the bearing points 10 and 13 of the support 8, the upwardly arched U-shape spring 12 being supported under slight prestress in bearing point 13. In an upper rest position, the limbs 14 and 15 and the contact element 5 are arranged on a line which runs above the bearing points 10 and 13. The application of a force to the operating element 3 brings about a curvature of the limbs 14 and 15 and an increase in the stress in the arched spring 12. When the point of action of the operating force, bearing point 13 and the contact element 5 are in one plane, the snap-action switching element 4 snaps into the other, contact-making position irrespective of the speed and force of operation.

The return of the snap-action force of operation. The return of the snap-action switching element 4, i.e. the opening of the contact likewise takes place automatically. As soon as the operating force approaches zero and its point of action, bearing point 13 and the contact element 5 are once more in one plane, the snap-action switching element 4 snaps back into the upper rest position.

In the dashed switch position, the contact element 5 acts as a link and makes the contact between the contact points 6 and 7, designed in the example with round wires made of conductor material, which are located in depressions 23 and 24 provided for this purpose in the housing 2 and are held in a manner not illustrated. They are a component of the wiring inside the switch.

The snap-action switching element 4 is open on its side 9. In order that the lateral limbs 14 and 15 cannot move out of the bearing point 10 when stressed, guide elements 25 and 26 are provided in the housing 2, on both sides.

A force which is applied from the outside onto the snap-action switch 1 is, in the simplest case, transmitted by a push button, which is not illustrated in more detail and in which the operating element 3 is integrated. Resetting is carried out via the snap-action switching element 4 itself. Further operating options for the operating element 3 which is guided in the part of the housing which is not shown are, of course, levers and bell cranks as well as toggles, slides transversely with respect to the operating direction and having wedge elements or conical elements, peg wheels or eccentric disks.

In the illustration according to FIG. 1, the snap-action switch 1 operates from an upper quiescent position as a make contact when it is switched into the dashed position, and a break contact in reverse. If two conductor tracks, which are not illustrated in more detail, are likewise made contact with in the upper position instead of one insulated stop point, a change-over function results.

Figure 2:
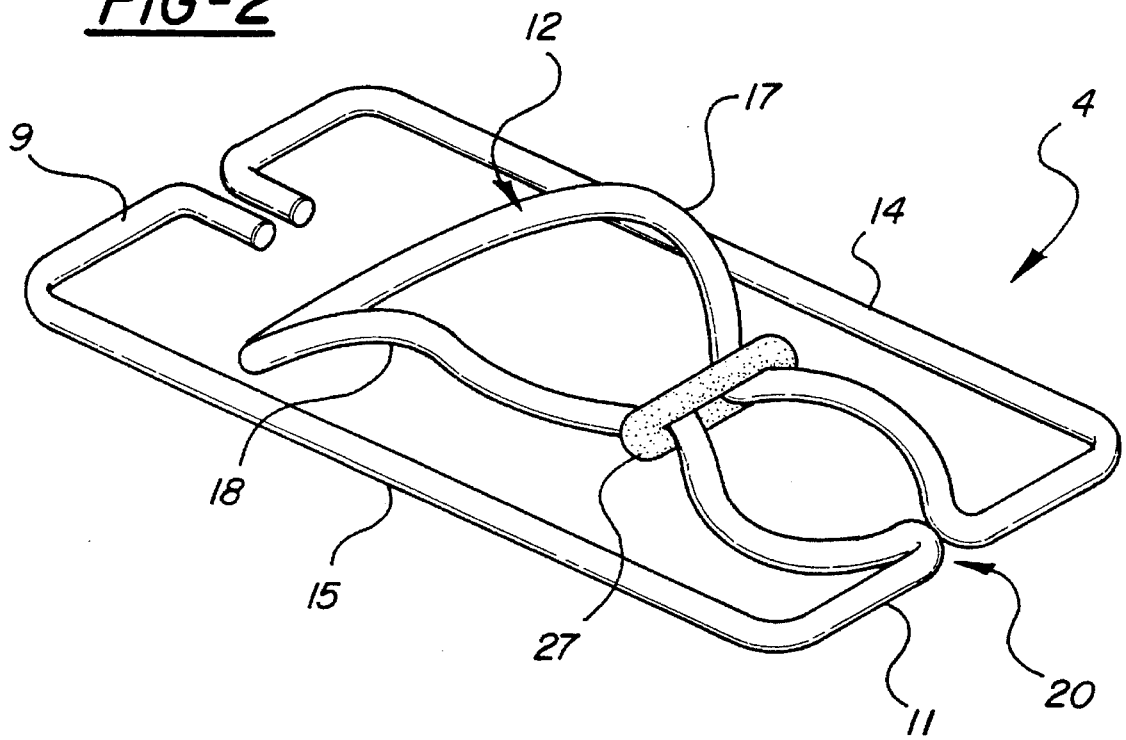
FIG. 2 shows a perspective view of a second exemplary embodiment of the snap-action switching element.
Figure 4:
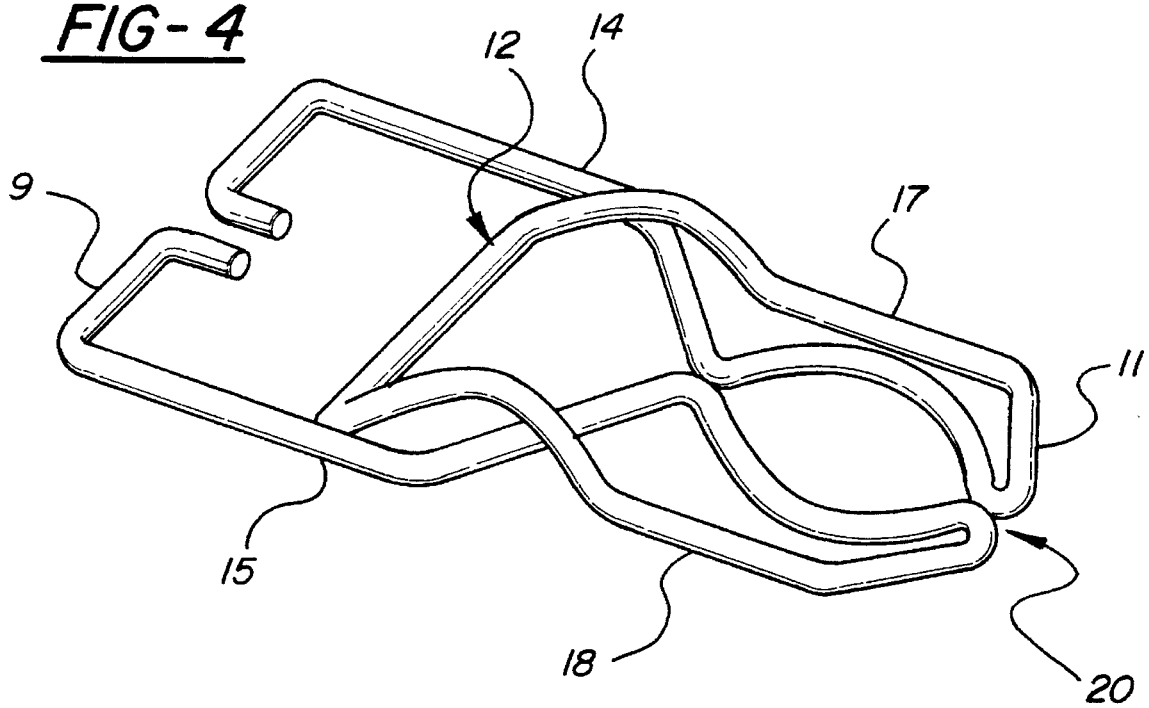
FIG. 4 shows a perspective view of a fourth exemplary embodiment of the snap-action switching element.
Figure 3:
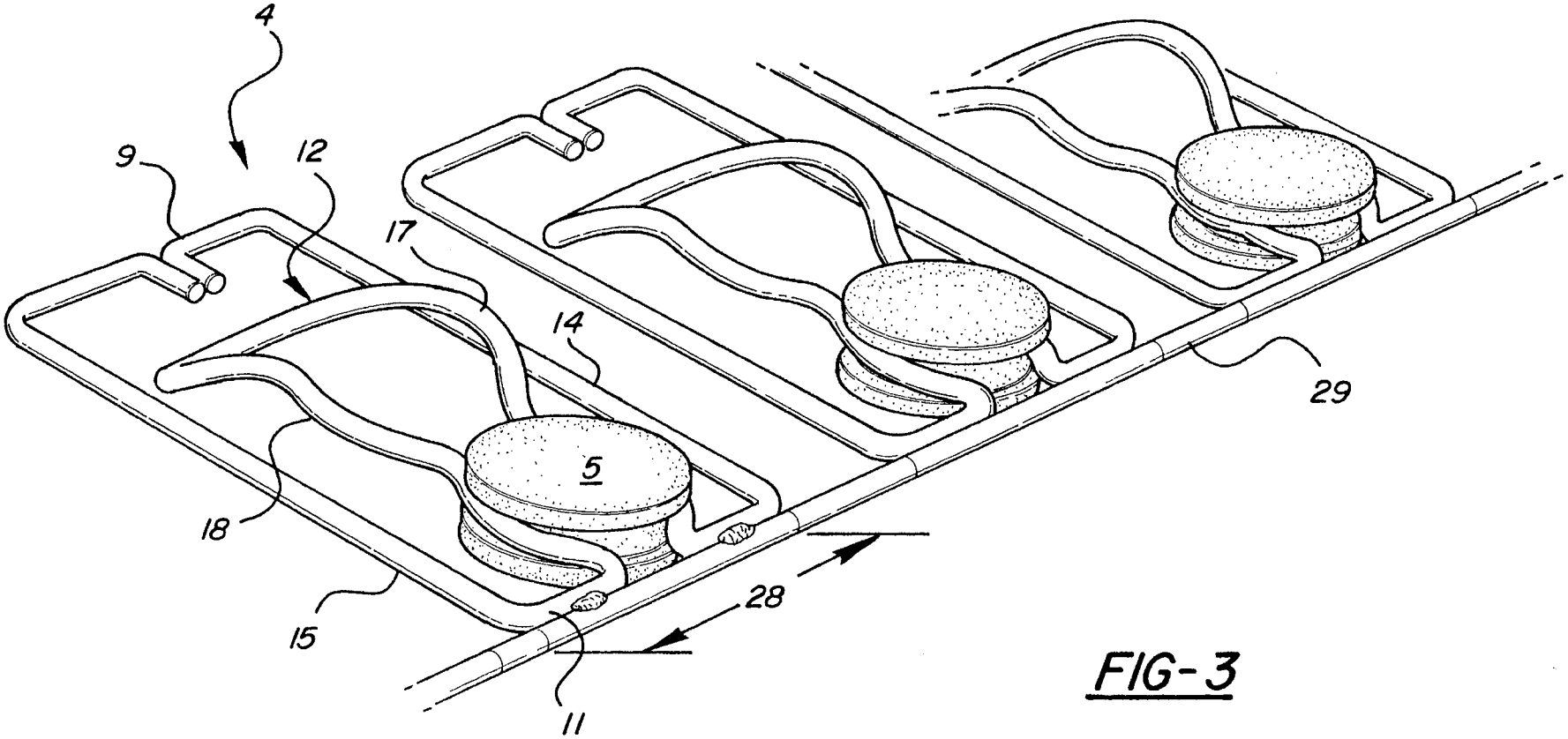
FIG. 3 shows a perspective view of a third exemplary embodiment of the snap-action switching element.

FIGS. 2 to 4 are limited to the illustration of the snap-action switching element 4 and show variants which counteract any possible spreading of the outer or lateral limbs 14, 15 when the snap-action switching element 4 is operated. The frame-like domed or arched structure for enhancing the snap-action effect briefly allows an upwardly directed movement of the lateral limbs 14, 15 when pressure is exerted, so that the bearing of the contact element 4 is undefined during this movement.

The inner limbs 17, 18 of the snap-action switching element 4 according to FIG. 2 are held together, after assembly of the contact element 5, by a bracket 27. The bracket 27 assists the constricting effect of the spring 12 between the contact element 5 and the bearing point 13.

In FIG. 3, a wire section 28 is fastened to the side 11 of the snap-action switching element 4, on both sides of the opening 20. The connection between the wire section 28 and the snap-action switching element 4 is of rigid design and can be effected by welding, soldering, crimping or similar permanent fastening methods. The wire section 28 is advantageously only part of a long wire 29 on which further snap-action switching elements 4 are arranged at defined intervals. An ordering and transportation means is produced, so that the loose arrangement, which otherwise exists, of snap-action switching elements 4 is avoided. The snap-action switching element 4 is not separated from the wire 29 until immediately before assembly.

A further variant of the snap-action switching element 4 is illustrated in FIG. 4. The inner limbs 17, 18 and outer limbs 14, 15 cross over one another so that the operation of the snap-action switching element 4 then results in the opening 20 being constricted, by virtue of the design. The contact element 5 is thus always borne securely.

What is claimed is:

1. An electrical snap-action switch having a housing, a contact element for connecting two contact points adopted to be fixed to the housing wherein said contact element is movable between two switch positions, a snap-action switching element supporting the contact element and an operating element which act on the snap-action switching element to cause the contact element to move from one switch position to the other switch position wherein the snap-action switching element is reset automatically to the one switch position by the snap-action switching element after said snap-action switching element has moved from one switch position to the other switch position, the snap-action switching element being constructed integrally from a wire, and the snap-action switching element including a generally rectangular frame having lateral limbs and two narrow sides with one side being held in a first bearing point on a support on said housing and an upwardly arched U-shaped spring projecting inwardly from the opposite side into the frame, the spring being supported in a slightly prestressed condition in a second bearing point on the support.

2. The electrical snap-action switch as claimed in claim 1, wherein the wire is round and is made of spring steel.

3. The electrical snap-action switch as claimed in claim 1, wherein the contact element is held between inner limbs of the U-shaped spring.

4. The electrical snap-action switch as claimed in claim 3, wherein a bracket is arranged around the inner limbs, between the second bearing point and the contact element.

5. The electrical snap-action switch as claimed in claim 3 wherein the lateral limbs of the snap-action element are protected against spreading apart from one another.

6. The electrical snap-action switch as claimed in claim 5, wherein a wire section is fastened to both inner limbs on one narrow side of the snap-action switching element.

7. The electrical snap-action switch as claimed in claim 1, wherein the lateral limbs of the snap-action element are protected against spreading apart from one another.

8. The electrical snap-action switch as claimed in claim 1, wherein the contact element is held between the lateral limbs of the snap-action switching element, and wherein inner limbs of the U-shaped spring extend across the lateral limbs.

9. The electrical snap-action switch as claimed in claim 1, wherein the contact element is round and is constructed with a contact surface which is crowned on at least one side thereof.

10. The electrical snap-action switch as claimed in claim 1, wherein guide elements for the operating element are constructed in the housing.

11. The electrical snap-action switch as claimed in claim 1 wherein the contact element is mounted for universal limited movement on the snap-action switching element.

12. An electrical snap-action switch of the type comprising a housing, a snap-action switching element mounted to the housing, having lateral limbs and two narrow sides, two contact points mounted to the housing, and an operating element which acts on the switching element and is guided in the housing for causing movement of the contact element from a first position to a second position, said switching element being automatically reset after the switching element has moved from one switch position to the other, the improvement comprising:

said switching element comprising a round wire forming a generally rectangular frame having first and second narrow sides with the first narrow side being held in a support on said housing and with an upwardly arched U-shape portion projecting from the second narrow side of the frame and seated against a bearing point of said support in a prestressed condition, said contact element being supported by the U-shaped spring portion.

13. An electrical snap-action switch as defined in claim 12 wherein said contact element defines an annular groove in its periphery, said wire frame having opposed arcuate portions seated loosely in said groove.

* * * * *